United States Patent [19]

Kozlin

[11] 4,009,569

[45] Mar. 1, 1977

[54] DIFFUSER-BURNER CASING FOR A GAS TURBINE ENGINE

[75] Inventor: Joseph R. Kozlin, West Hartford, Conn.

[73] Assignee: United Technologies Corporation, Hartford, Conn.

[22] Filed: July 21, 1975

[21] Appl. No.: 597,875

[52] U.S. Cl. ..... 60/39.32; 60/39.37

[51] Int. Cl.[2] ..... F02C 7/20; F02C 3/00

[58] Field of Search ..... 60/39.31, 39.32, 39.37, 60/39.36; 415/219, 189, 201

[56] References Cited

UNITED STATES PATENTS

| | | | |
|---|---|---|---|
| 2,778,192 | 1/1957 | Kroon | 60/39.32 |
| 3,759,038 | 9/1973 | Scalzo | 60/39.32 |

*Primary Examiner*—Carlton R. Croyle
*Assistant Examiner*—L. J. Casoregola
*Attorney, Agent, or Firm*—Vernon F. Hauschild

[57] ABSTRACT

A diffuser-burner casing in the combustion section of an axial flow gas turbine engine transmits axial engine loads between the compressor section and the turbine section and serves as a housing for the combustion chamber assemblies and as a bearing support for the shaft or shafts extending between the compressor and turbine sections. The casing has outer, intermediate and inner ring portions structurally interconnected for limited flexure under the influence of thermal gradients and stresses. The outer ring portion is connected to the intermediate ring portion by means of a frustoconical wall portion which defines the forward part of an annular plenum in which the combustion chamber assemblies are located. The intermediate ring portion and the inner ring portion are interconnected by means of a plurality of circumaxially spaced struts, and form the diffuser for the compressor which discharges into the annular plenum containing the combustion chamber assemblies. A removable plenum cover connects with the outer ring portion and the inner surface of the cover defines an outer wall of the plenum chamber. The plenum cover also connects at its rearward end with a turbine casing and is retractable over the turbine casing in order to permit the combustion chamber assemblies to be installed or removed.

11 Claims, 5 Drawing Figures

DIFFUSER-BURNER CASING FOR A GAS TURBINE ENGINE

BACKGROUND OF THE INVENTION

The present invention relates to gas turbine engines and, more particularly, is concerned with a diffuser-burner casing forming a structural member between the compressor section and the turbine section of such an engine.

Gas turbine engines are now widely used as power sources in both stationary and moving environments. For example, it is common to utilize industrial gas turbine engines as the power sources in an electric power plant. Even more common is the use of gas turbine engines as the power plants for large vehicles such as airplanes. A relativly common design for such gas turbine engines is the axial flow engine in which air is ingested through an inlet at the front of the engine an moves generally axially through a compressor section, a combustion section, where the fuel and air mix and burn, and a turbine section in which the burning gases drive single or multistage turbines before being expelled through an exhaust diffuser at the rear of the engine. In turbojet engines such as used in jet aircraft, the exhaust gases are used primarily to develop thrust; whereas in industrial engines the exhaust gases drive a power turbine having a mechanical output connected to a power absorbing device such as an electrical generator.

In gas turbine engines producing either thrust or mechanical output, the combustion or "hot" section of the engine, should be designed to take into consideration many factors. There is substantial thermal stressing within the engine casing in the area of the burners and compressor diffuser because the combustion process is continuous and produces intense heat at some local regions within the casing while other regions are maintained relatively cool by the continuous flow of air from the compressor diffuser to the burners in the combustion chamber assemblies. The diffuser-burner casing also serves as a structural member between the compressor and turbine sections and hence transmits axial loads between the compressor at the front of the engine and the turbine at the rear of the engine. Additionally, one or more drive shafts may extend through the diffuser-burner casing to transmit power from turbines to the various compressors or fans in the forward part of the engine. Hence, the diffuser-burner casing may provide support for shaft bearings in the midportion of the engine. Still further, the casing may cooperate with the compressor by defining the diffuser geometry and the air flow path between the diffuser and the combustion chamber assemblies. That flow path should promote uniform diffusion and distribution of air from the compressor to the combustion chamber assemblies for most efficient mixing and burning in the various combustion chamber assemblies. In addition to all of the above features, it is desirable that maintenance and servicing of the "hot" section of the engine be carried out with minimum time and effort. Thus, the design of the casing in the vicinity of the combustion section is of special interest and importance to the overall functioning and operation of the turbine engine.

It is, accordingly, a general object of the present invention to provide a diffuser-burner casing having all of the above features in the area of the combustion section of a gas turbine engine.

SUMMARY OF THE INVENTION

The present invention resides in a diffuser-burner casing for a gas turbine engine in which casing a generally axial flow of air moves between the compressor section at the front of the engine and the turbine section at the rear. In conventional fashion, a plurality of combustion chamber assemblies are distributed in circumaxially spaced relationship about the engine axis and within the casing upstream in the air flow of the turbine section.

The diffuser-burner casing is comprised of an outer structural ring portion, an intermediate structural ring portion and an inner structural ring portion. A frustoconical wall portion interconnects the outer and intermediate ring portions and defines the forward part of an annular plenum in which the combustion chamber assemblies are disposed. The intermediate ring portion spaced radially inward of the outer ring portion forms at least part of the outer wall of an annular compressor diffuser so that air leaving the diffuser passes into the plenum defined in part by the frustoconical wall portion.

The inner structural ring portion is spaced radially inward of the intermediate ring portion and forms at least part of the inner wall of the compressor diffuser. Accordingly, the annular space between the intermediate and inner ring portions comprises at least part of the compressor diffuser duct. A plurality of struts distributed about the engine axis extend through the diffuser duct between the intermediate and inner ring portions to maintain the positional relationship of the intermediate and inner ring portions.

A removable plenum cover connects with the outer structural ring portion and circumscribes the engine to define at its inner surface a radially outer wall of the annular plenum into which the compressor diffuser discharges and in which the combustion chamber assemblies are disposed.

DESCRIPTION OF THE PREFERRED EMBODIMENT

Figure 1:
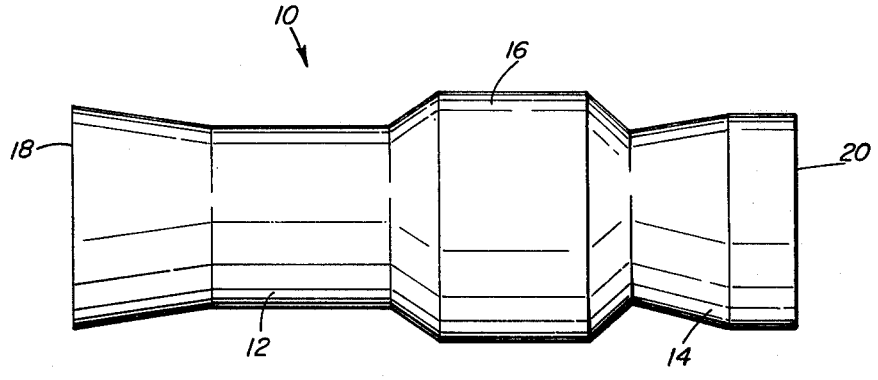
FIG. 1 illustrates in profile a gas turbine engine in which the novel diffuser-burner casing of the present invention may be employed.

FIG. 1 illustrates an axial flow gas turbine engine, generally designated 10, having a compressor section 12, a turbine section 14 and a combustor or combustion section 16. The engine may be utilized as a jet engine producing thrust from a high-velocity discharge or as a power turbine engine having a mechanical output such as used in an electrical power generation plant. Air flows generally axially through the engine from an inlet 18 at the front of the compressor section 12 to the combustion section 16 where it combines with fuel and produces combustion gases. The gases flow through the turbine section 14 and leave the engine through the exhaust duct 20 at the rear. Within the turbine section 14, the combustion gases drive one or more turbine stages depending upon the design of the engine and its intended use.

Figure 3:
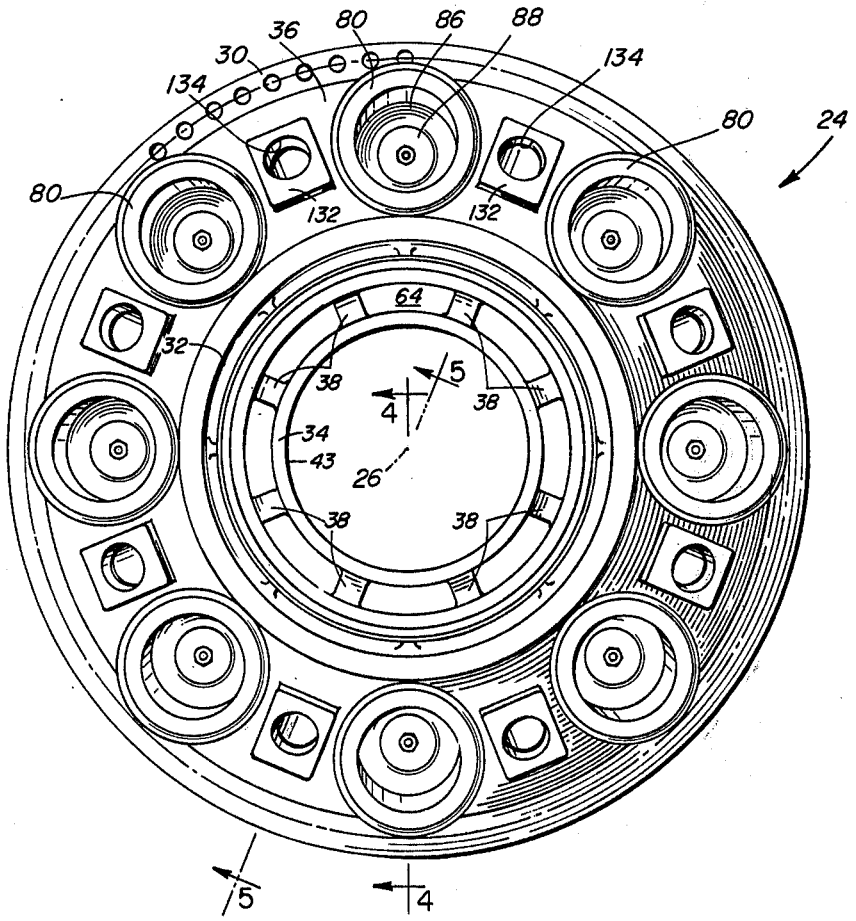
FIG. 3 is an axial end view of the diffuser-burner casing as the casing appears looking rearwardly through the engine.
Figure 2:
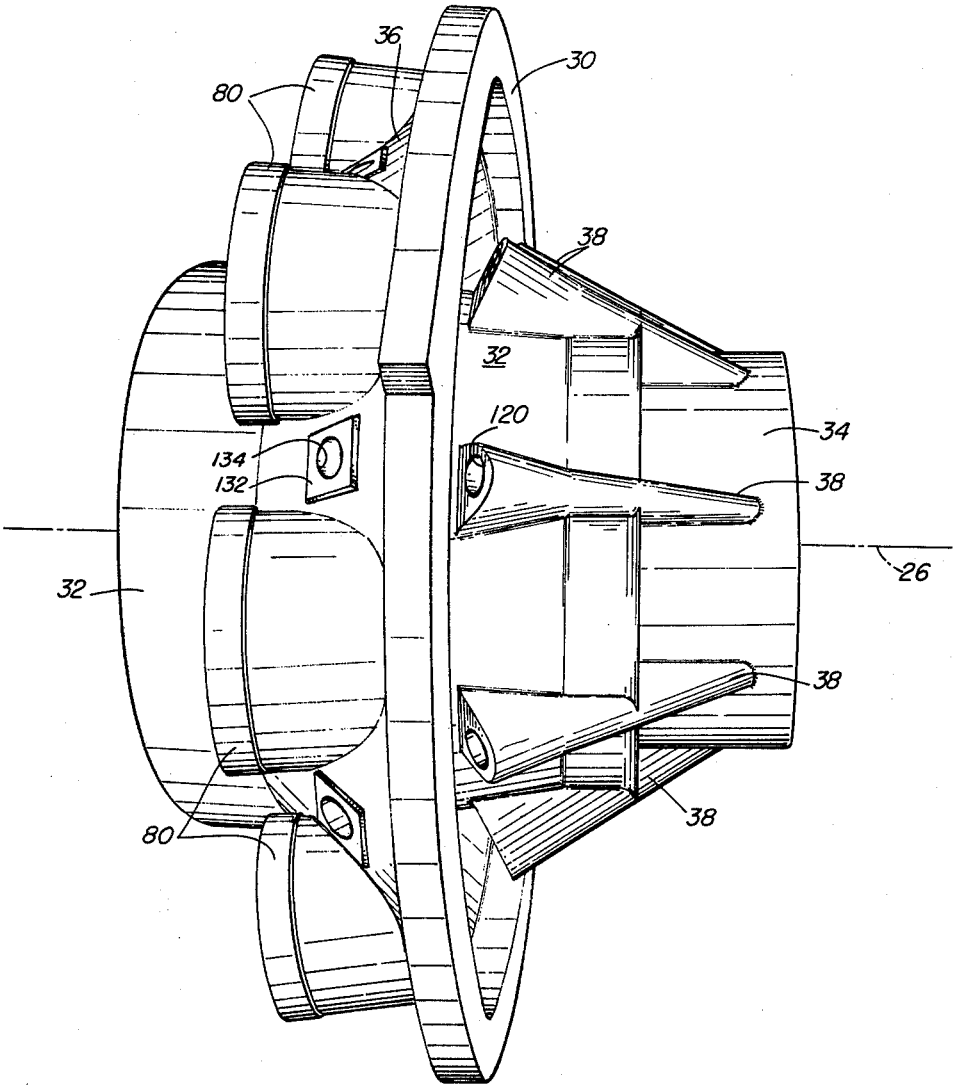
FIG. 2 is a perspective view of the diffuser-burner casing from the side with the removable plenum cover removed to show the inner casing structure.

Turning more particularly to the present invention, FIGS. 2 and 3 illustrate the diffuser-burner casing, generally designated 24, which may be used to form the backbone or structural frame of the engine 10 in the region of the combustion section 16 in FIG. 1. The casing 24 has a generally cylindrical outline which defines the central axis 26 of the engine within the combustion section. The casing also defines the basic internal geometry of the "hot" section of the engine in which the combustion chamber assemblies are installed and the geometry of the compressor diffuser from which air is discharged for the combustion process. Additionally, the casing provides servicing for the power shafts at the midsection of the engine and permits maintenance, inspection and repairs to be carried out on the components within the "hot" section.

The casing 24 has three coaxially arranged and interconnected portions, namely an outer flange or ring 30, an intermediate ring 32 and an inner ring 34. A frustoconical wall 36 interconnects the outer ring 30 and the intermediate ring 32 in an axially offset or cantilevered relationship which converts the axial loads carried through the engine into hoop loads within the rings 30 and 32. A plurality of circumaxially spaced struts 38 interconnect the intermediate ring 32 and the inner ring 34 in an axially offset or cantilevered relationship in order to provide flexibility in the ring-strut-ring structure so that thermal gradients and associated stresses produced by the elevated air temperatures in the compressor diffuser near the axis 26 of the engine do not create undue stresses as the inwardly disposed components of the engine tend to expand or grow.

Figure 4:
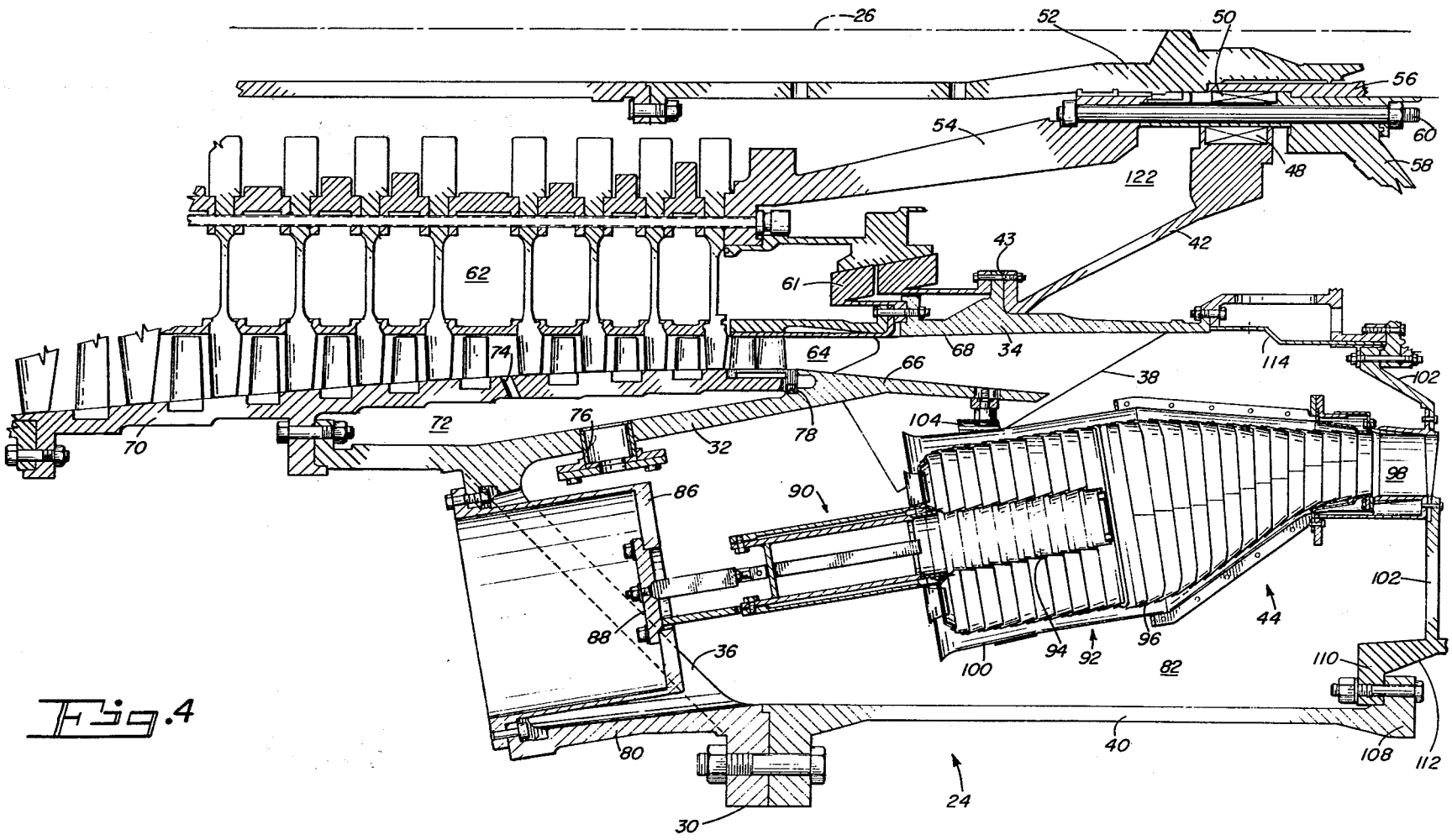
FIG. 4 is a fragmentary longitudinal cross section of the diffuser-burner casing as viewed along the sectioning line 4—4 in FIG. 3 and additionally shows the rearward stages of the high pressure compressor, a combustion assembly within the casing and the bearing support structure for the drive shafts between the compressor section and the turbine section.
Figure 5:
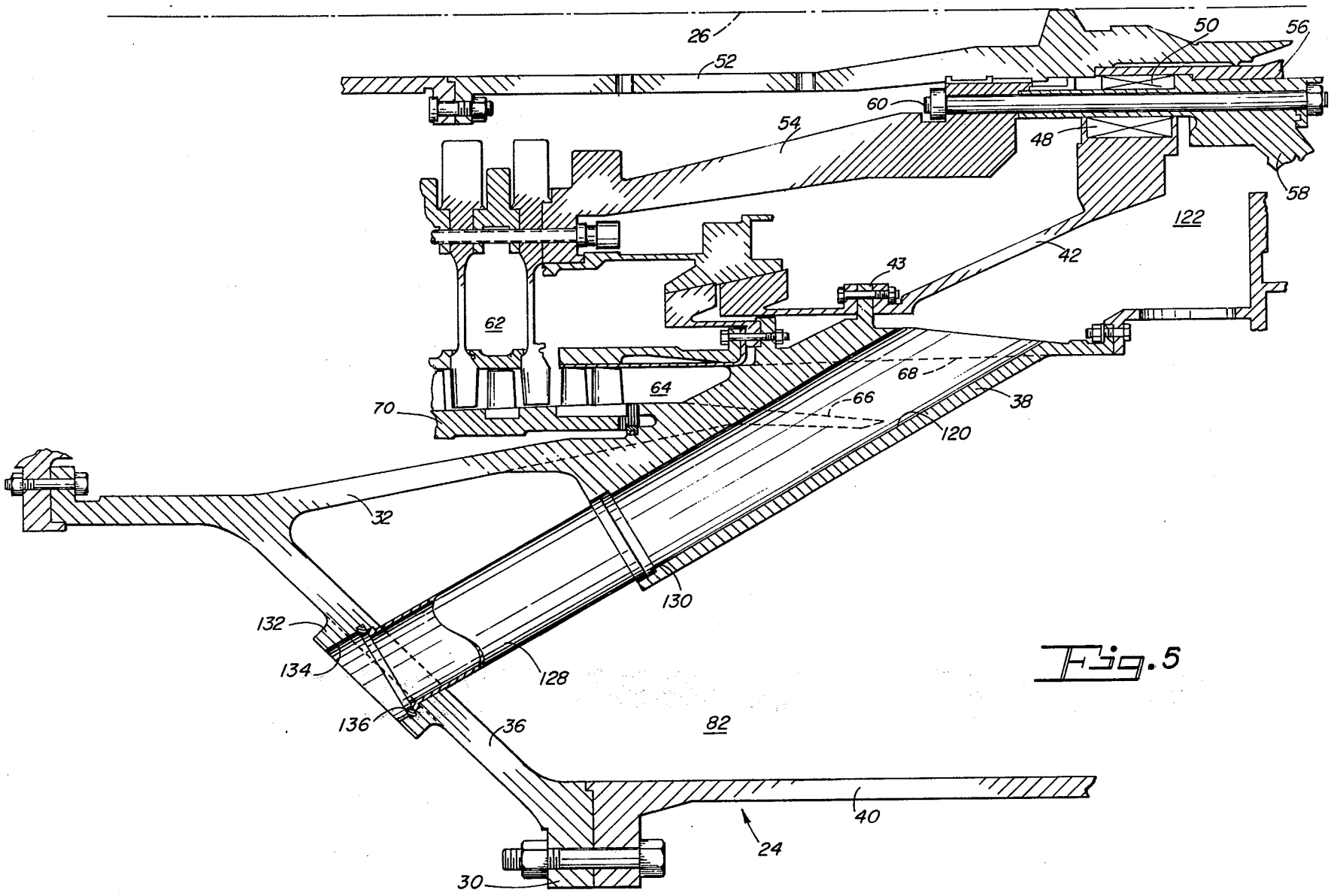
FIG. 5 is another longitudinal section of the diffuser-burner casing similar to FIG. 4 but taken along the sectioning line 5—5 in FIG. 3.

Additional parts of the casing 24 shown in FIGS. 4 and 5 together with other selected components of the engine include a removable plenum cover 40 and a frustoconical bearing support 42 connected to the inner ring 34. The plenum cover 40 bolts to the rear face of the ring 30 and has an inner surface which defines the outer wall of the plenum in which a plurality of circumaxially spaced combustion chamber assemblies, only one shown and generally designated 44, are disposed. The bearing support 42 extends radially inward from an inwardly projecting flange 43 on the inner ring 34 to a pair of coaxially arranged bearings 48 and 50. The bearings support a high pressure compressor shaft 54, a low pressure compressor shaft 52 and the turbine drive shafts 56 and 58 connected respectively with the shafts 52 and 54. The outer bearing 48 is located between the bearing support 42 and the turbine drive shaft 58 which is joined with the high pressure compressor shaft 54 by a circular array of aligning bolts 60. The inner bearing 50 is interposed between the turbine shaft 58 and the turbine shaft 56 connected to the low pressure compressor shaft 52 to permit the respective compressors and turbines to rotate at different speeds. While the illustrated bearing structure is for a gas turbine engine having two separately driven compressors, it is obvious that the bearing support 42 may also be used in an engine having a single compressor or an engine having a power take-off shaft which extends from a turbine section at the rear of the engine forwardly through the compressor section and the engine inlet.

In FIG. 4, it will be observed tha the annular duct 64 forming the diffuser for the high pressure compressor 62 has an outer wall 66 defined at least in part by a rearwardly extending portion of the intermediate ring 32, and an inner wall 68 defined in part by the inner ring 34. Thus, air discharging from the compressor 62 flows between the rings 32 and 34 and over the struts 38 interconnecting those rings. With a compressor section of the engine generating an overall pressure ratio in the order of 15 to 1, the discharging air will be relatively hot compared, for example, to the ambient temperature at the outer ring 30. The frustoconical wall portion 36 and the portion of the intermediate ring 32 between the diffuser duct and the connection with the wall portion 36 advantageously provide flexibility between the diffuser and the outer ring 30 to absorb the stresses generated by the thermal gradients existing between the diffuser and the structural outer ring 30.

A labyrinth seal 61 is also disposed between the inner ring 34 of the casing 24 and the high pressure compressor shaft 54 to prevent the air from the diffuser from leaking into the center of the engine where the bearings are located.

The intermediate ring 32 cooperates with the high pressure compressor casing 70 to define a bleed manifold 72. A plurality of bleed apertures 74 are located between selected stages of the compressor 62 to discharge air into the manifold 72 and a discharge conduit connection 76 is disposed in the intermediate ring 32 for transferring the bleed air to other portions of the engine for cooling or other purposes. An air seal 78 is provided at the rear lip of the compressor casing 70 to seal the manifold 72 at the junction of the casing and the intermediate ring 32.

The frustoconical wall portion 36 between the intermediate ring 32 and the outer ring 30 provides a number of access openings through which the "hot" section of the engine and the bearings 48 and 50 may be serviced. The wall portion 36 as shown most clearly in FIGS. 3 and 4 has a plurality of dormers or part defining numbers 80, each of which is axially aligned with one of the combustion chamber assemblies 44 located in the large annular plenum 82 receiving air discharged from the compressor diffuser. In each of the dormers, a recessed aperture cover 86 is mounted and serves as an outer support for the combustion chamber assemblies 44 and for the fuel injection assemblies (not shown) which extend between the cover and the combustion assemblies 44. A removable plate 88 at the center of the cover 86 provides access to a structure in FIG. 4 generally designated 90 which supports the burner can 92 of the assembly 44. The plate 88 allows the center liner 94 of the burner can 92 to be removed as described in greater detail in copending U.S. patent application Ser. No. 597,877 filed July 21, 1975 having the same assignee as the present application. Removal of the entire cover 86 allows the complete burner can 92 with the center liner 94 and the fuel injection assemblies to be removed and installed in the engine independently of the transition duct 96 which connects the burner can 92 with the inlet 98 to the turbine section of the engine.

The transition duct 96 and a cooling shroud 100 covering the burner can 92 are attached to a partition 102 between the combustion section and the rearwardly located turbine section. Additional support for the forward end of the cooling shroud 100 is provided by a belly band 104 which connects with the intermediate ring 32 at the trailing edge of the compressor diffuser.

The plenum cover 40 is connected at its forward end to the flange or ring 30 and at its rearward end has an inwardly extending flange 108 which is bolted to an outwardly extending flange 110 of the turbine casing 112. With such connection to the turbine casing 112, the plenum cover 40 may be unbolted from both the ring 30 and the turbine casing 112 and then be retracted axially rearwardly of the engine to open the plenum and allow a complete combustion chamber assembly 44 including the transition duct 96 and cooling shroud 100 to be removed. Thus, the diffuser-burner casing 24 provides access through the recessed cover 86 of the plate 88 for limited maintenance, replacement or inspection of the burners and fuel injection assemblies, and by virtue of the retractable cover 40, allows an entire combustion chamber assembly to be inspected, removed or installed.

In cooperation with the turbine casing 112, the partition 102 and a perforated manifold cover ring 114, the casing 24 defines the annular plenum chamber 82 into which the compressor air is discharged. Within this plenum the plurality of combustion chamber assemblies 44 are mounted as mentioned above. As shown in FIG. 4, the air from the compressor diffuser must first pass over the cooling shrouds 100 of the assemblies and then turn toward a forward portion of the plenum defined by the frustoconical wall portion 36. Then the air turns again toward the rear of the plenum and enters the forward end of the shroud 100 and the burner cans 92 where combustion takes place. Turning the air flow in this manner allows turbulence and high velocities at the diffuser exit to be eliminated in the more spacious portion of the plenum 82 so that a more uniform pressure distribution and flow pattern exists where the air enters the combustion chamber assemblies. Thus, although the air flow is generally axial through the engine, the flow path in the combustion section is folded back upon itself for improved aerodynamics which also permits the overall length of the engine to be reduced.

It will be noted from FIGS. 2 and 3 that the numbers 80 and, correspondingly the combustion chamber assemblies 44 in the plenum 82 behind each of the dormers, lie in radial planes intersecting the engine axis 26 which are different from the radial planes in which the struts 38 lie. The circumaxial interdigitation of the struts and combustion assemblies avoids any interference that would exist between the two sets of engine components. Additionally, the interdigitation allows hydraulic, cooling and other service lines for the bearings 48 and 50 and the surrounding bearing compartment to pass from the outer face of the frustoconical wall portion 36 through one or more of the struts 38 at a distance from the higher temperature combustion assemblies.

FIG. 5 illustrates a sectional view of the casing 24 through one of the struts 38 and clearly shows a passageway 120 in the strut leading to the compartment 122 in which the bearings 48 and 50 lie. To permit radial growth of the casing in the vicinity of the inner ring 34, the strut 38 and the intermediate ring 32, the strut 38 terminates at its outer end within the forward portion of the annular plenum 82, and a tubular shield 128 extends between the outer end of the strut and the frustonconical wall portion 36. The inner end of the shield 128 fits within a recess 130 of the strut at the outer end of the passageway 120. The outer end of the shield is mounted in a region of the wall portion 36 having a raised boss 132, and is held by means of a retaining ring 136 within an aperture 134 registering in the boss with the axis of the passageway 120. The overall length of the shield between its inner and outer end is less than the distance between the retaining ring 136 and the seat of the recess 130, and one or both ends of the shield are permitted to slide relative to the engaging portions of the casing to accommodate relative movement of these parts generated by thermal or other stresses. Preferably, both ends of the shield are provided with seals to prevent leakage of the high pressure air in the plenum 82 through the joints of the shield and into the passageway 120 enclosing the sevice lines extending through the strut 38 and wall portion 36.

Accordingly, the diffuser-burner case 24 performs many important functions in the operation of the gas turbine engine and includes several features enhancing the maintenance and inspection of the "hot" section of the engine. The axially offset or cantilevered ring portions and interconnecting frustoconical wall portions or struts provide a limited degree of flexibility which minimizes the effects of thermal stresses originating in the area of the diffuser duct 64 formed by the casing elements themselves. The dormers 80 in the frustoconical wall portion 36 allow the burner cans 92 to be readily repaired or inspected, and the retractable plenum cover 40 allows major repairs of the complete combustion chamber assemblies to be performed without total disassembly of the engine. Support for the intermediate bearings in the engine is derived from the inner ring portion 34, and servicing for the bearings and surrounding compartment 122 may be provided through one or more of the struts 38. The compressor casing 70 and the intermediate ring 32 also cooperate to form a bleed manifold for the compressor.

While the present invention has been described in a preferred embodiment, it will be understood that sutiable modifications and substitutions can be made without eliminating the many features provided by the illustrated casing. For example, it will be understood that the number of dormers, struts and combustion chamber assemblies distributed circumaxially about the casing may be varied. The plenum cover 40 may also split longitudinally in addition to being axially retractable as disclosed. The intermediate ring portion 32 need not extend well forward of the frustoconical wall portion 36 since the bleed manifold 72 may be formed wholly within the compressor casing 70 or by other structure. Accordingly, the present invention has been described in a preferred embodiment by way of illustration rather than limitation.

I claim:

1. A diffuser-burner casing for a gas turbine engine in which casing a generally axial flow of air rearwardly from the diffuser of the engine compressor is directed into combustion chamber assemblies distributed in circumaxially spaced relationship about the engine axis upstream in the flow from or forward of the turbine section of the engine comprising:

an outer structural ring portion;

an intermediate structural ring portion having an expansible connecting means and a rigid connecting means, said intermediate structural ring portion being spaced radially inward of the outer ring portion and shaped to envelop the compressor case and to expandibly engage the compressor case hot portion via said expansible connecting means, and to structurally engage the compressor case cold portion via said rigid connecting means, and to join at least part of the outer wall of the compressor diffuser;

a frustoconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct; and a removable plenum cover connecting with the outer structural ring portion and circumscribing the engine to define at its inner surface a radially outer wall of the annular plenum in which the combustion chamber assemblies are disposed.

2. A diffuser-burner casing for a gas turbine engine as defined in claim 1 wherein the intermediate structural ring portion extends axially forward of the compressor diffuser; and the frustoconical wall portion is connected to the intermediate structural ring portion forward of the part of the intermediate ring portion forming the outer diffuser wall.

3. A diffuser-burner casing for a gas turbine engine in which casing a generally axial flow of air rearwardly from the diffuser of the engine compressor is directed into combustion chamber assemblies distributed in circumaxially spaced relationship about the engine axis upstream in the flow from the forward of the turbine section of the engine comprising:

an outer structural ring portion;

an intermediate structural ring portion spaced radially inward of the outer ring portion and forming at least part of the outer wall of the comrpessor diffuser;

a frustoconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct;

a removable plenum cover connecting with the outer structural ring portion and circumscribing the engine to define at its inner surface a radially outer wall of the annular pleum in which the combustion chamber assemblies are disposed; and further including:

a plurality of port defining members exposed externally on the frustoconical wall portion at locations corresponding with the locations of combustion chamber assemblies within the plenum, said port defining members in the frustoconical wall portion are centered in radial planes inersecting the engine axis which planes are different from the radial planes in which the struts are centered.

4. A diffuser-burner casing for a gas turbine engine in which casing a generally axial flow of air rearwardly from the diffuser of the engine compressor is directed into combustion chamber assemblies distributed in circumaxially spaced relationship about the engine axis upstream in the flow from or forward of the turbine section of the engine comprising:

an outer structural ring portion;

an intermediate structural ring portion spaced radially inward of the outer ring portion and forming at least part of the outer wall of the compressor diffuser;

a frustoconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct;

a removable plenum cover connecting with the outer structural ring portion and circumscribing the engine to define at its inner surface a radially outer wall of the annular plenum in which the combustion chamber assemblies are disposed; and in which the compressor stator vanes are mounted in a compressor casing wherein:

the intermediate structural ring portion extends axially forward of the compressor diffuser and cooperates with the compressor casing to define a bleed air manifold for the compressor.

5. A diffuser-burner casing for a gas turbine engine in which casing a generally axial flow of air rearwardly from the diffuser of the engine compressor is directed into combustion chamber assemblies distributed in circumaxially spaced relationship about the engine axis upstream in the flow from or forward of the turbine section of the engine comprising:

an outer structural ring portion;

an intermediate structural ring portion spaced radially inward of the outer ring portion and forming at least part of the outer wall of the compressor diffuser;

a frustoconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct;

a removable plenum cover connecting with the outer structural ring portion and circumscribing the engine to define at its inner surface a radially outer wall of the annular plenum in which the combustion chamber assemblies are disposed; and through which casing extends a shaft interconnecting the turbine and compressor further including:

bearing support means connected with the inner structural ring portion for supporting bearings for the shaft between the turbine and the compressor.

6. A diffuser-burner casing for a gas turbine engine in which casing a generally axial flow of air rearwardly from the diffuser of the engine compressor is directed into combustion chamber assemblies distributed in circumaxially spaced realationship about the engine axis upstream in the flow from or forward of the turbine section of the engine comprising:

an outer structural ring portion;

an intermediate structural ring portion spaced radially inward of the outer ring portion and forming at least part of the outer wall of the compressor diffuser;

a frustonconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct;

a removable plenum cover connecting with the outer structural ring portions and circumscribing the engine to define at its inner surface a radially outer wall of the annular plenum in which the combustion chamber assemblies are disposed;

through which casing extends a shaft interconnecting the turbine and compressor further including:

bearing support means connected with the inner strucutral ring portion for supporting bearings for the shaft between the turbine and the compressor; and wherein:

the inner structural ring portion has a flange; and the bearing support means comprises a frustoconically shaped ring member mounted to the flange of the inner ring portion.

7. A diffuser-burner casing for a gas turbine engine in which casing a generally axial flow of air rearwardly from the diffuser of the engine compressor is directed into combustion chamber assemblies distributed in circumaxially spaced relationship about the engine axis upstream in the flow from or forward of the turbine section of the engine comprising:

an outer structural ring portion;

an intermediate structural ring portion spaced radially inward of the outer ring portion and forming at least part of the outer wall of the compressor diffuser;

a frustoconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct;

a removable plenum cover connecting with the outer structural ring portion and circumscribing the engine to define at its inner surface a radially outer wall of the annular plenum in which the combustion chamber assemblies are disposed;

through which casing extends a shaft interconnecting the turbine and compressor further including:

bearing support means connected with the inner structural ring portion for supporting bearings for the shaft between the turbine and the compressor; and wherein:

at least one of the struts between the intermediate and inner ring portions has a passageway extending from a radially outer strut end to a radially inner strut end to provide servicing for the shaft bearings.

8. A diffuser-burner casing for a gas turbine engine in which casing a generally axial flow of air rearwardly from the diffuser of the engine compressor is directed into combustion chamber assemblies distributed in circumaxially spaced relationship about the engine axis upstream in the flow from or forward of the turbine section of the engine comprising:

an outer structural ring portion;

an intermediate structural ring portion spaced radially inward of the outer ring portion and forming at least part of the outer wall of the compressor diffuser;

a frustoconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct;

a removable plenum cover connecting with the outer structural ring portion and circumscribing the engine to define at its inner surface a radially outer wall of the annular plenum in which the combustion chamber assemblies are disposed;

through which casing extends a shaft interconnecting the turbine and compressor further including:

bearing support means connected with the inner structural ring portion for supporting bearings for the shaft between the turbine and the compressor;

wherein:

at least one of the struts between the intermediate and inner ring portions has a passageway extending from a radially outer strut end to a radially inner strut end to provide servicing for the shaft bearings; and wherein:

the one of the struts having a passageway has a radially outer strut end terminating with the annular plenum; and the frustoconical wall portion interconnecting the intermediate and outer ring portions has an aperture axially registering with the passageway at the outer end of the strut.

9. A diffuser-burner casing for a gas turbine engine in which casing a generally axial flow of air rearwardly from the diffuser of the engine compressor is directed into combustion chamber assemblies distributed in circumaxially spaced relationship about the engine axis upstream in the flow from or forward of the turbine section of the engine comprising:

an outer structural ring portion;

an intermediate structural ring portion spaced radially inward of the outer ring portion and forming at least part of the outer wall of the compressor diffuser;

a frustoconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct;

a removable plenum cover connecting with the outer structural ring portion and circumscribing the engine to define at its inner surface a radially outer wall of the annular plenum in which the combustion chamber assemblies are disposed;

through which casing extends a shaft interconnecting the turbine and compressor further including:

bearing support means connected with the inner structural ring portion for supporting bearings for the shaft between the turbine and the compressor;

wherein:

at least one of the struts between the intermediate and inner ring portions has a passageway extending from a radially outer strut end to a radially inner strut end to provide servicing for the shaft bearings;

wherein:

the one of the struts having a passageway has a radially outer strut end terminating within the annular plenum; and the frustoconical wall portion interconnecting the intermediate and outer ring portions has an aperture axially registering with the passageway at the outer end of the strut; and further including a tubular shield extending through the forward part of the annular plenum and connected at one end with the outer strut end of the strut having the pasageway and at the opposite end with the frustoconical wall at the aperture.

10. A diffuser-burner casing for a gas turbine engine in which casing a generally axial flow of air rearwardly from the diffuser of the engine compressor is directed into combustion chamber assemblies distributed in circumaxially spaced relationship about the engine axis upstream in the flow from or forward of the turbine section of the engine comprising:

an outer structural ring portion;

an intermediate structural ring portion spaced radially inward of the outer ring portion and forming at least part of the outer wall of the compressor diffuser;

a frustonconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct;

a removable plenum cover connecting with the outer structural ring portion and circumscribing the engine to define at its inner surface a radially outer wall of the annular plenum in which the combustion chamber assemblies are disposed;

through which casing extends a shaft interconnecting the turbine and compressor further including:

bearing support means connected with the inner structural ring portion for supporting bearings for the shaft between the turbine and the compressor;

wherein:

at least one of the struts between the intermediate and inner ring portions has a passageway extending from a radially outer strut end to a radially inner strut end to provide servicing for the shaft bearings;

wherein:

the one of the struts having a passageway has a radially outer strut end terminating within the annular plenum; and the frustoconical wall portion interconnecting the intermediate and outer ring portions has an aperture axially registering with the passageway at the outer end of the strut;

further including a tubular shield extending through the forward part of the annular plenum and connected at one end with the outer strut end of the strut having the passageway and at the opposite end with the frustonconical wall at the aperture; and wherein the tubular shield has an axially slidable connection at one end whereby thermal expansions or contractions of the casing between the intermediate ring portion and the frustoconical wall portion are accommodated.

11. A diffuser-burner casing for a gas turbine engine in which casing a generally axial flow of air rearwardly from the diffuser of the engine compressor is directed into combustion chamber assemblies distributed in circumaxially spaced relationship about the engine axis upstream in the flow from or forward of the turbine section of the engine comprising:

an outer structural ring portion;

an intermediate structural ring portion spaced radially inward of the outer ring portion and forming at least part of the outer wall of the compressor diffuser;

a frustoconical wall portion interconnecting the outer and intermediate ring portions and defining a forward part of an annular plenum in which the combustion chamber assemblies are disposed;

an inner structural ring portion spaced radially inward of the intermediate ring portion and forming at least part of the inner wall of the compressor diffuser whereby the annular space between the intermediate and inner ring portions comprises at least part of the diffuser duct;

a plurality of struts distributed about the engine axis and extending between the intermediate and inner ring portions and through the diffuser duct;

a removable plenum cover connecting with the outer structural ring portion and circumscribing the engine to define at its inner surface a radially outer wall of the annular plenum in which the combustion chamber assemblies are disposed; and in which engine another casing circumscribes the turbine section of the engine wherein:

the removable plenum cover is also connected at its rearward end with the casing circumscribing the turbine section said plenum cover overlapping the turbine casing and thus being retractable rearwardly from the outer ring portion and over the turbine casing to expose the combustion chamber assemblies in the annular plenum.

* * * * *